US010480442B2

(12) United States Patent
Sato et al.

(10) Patent No.: US 10,480,442 B2
(45) Date of Patent: Nov. 19, 2019

(54) WORKING MACHINE AND WORKING MACHINE MONITORING SYSTEM

(71) Applicant: HITACHI CONSTRUCTION MACHINERY CO., LTD., Tokyo (JP)

(72) Inventors: Shinya Sato, Tokyo (JP); Masatoshi Hoshino, Tokyo (JP); Kouji Ishikawa, Tsuchiura (JP); Shinji Ishihara, Tokyo (JP)

(73) Assignee: Hitachi Construction Machinery Co., Ltd., Tokyo (JP)

( * ) Notice: Subject to any disclaimer, the term of this patent is extended or adjusted under 35 U.S.C. 154(b) by 0 days.

(21) Appl. No.: 16/218,597

(22) Filed: Dec. 13, 2018

(65) Prior Publication Data

US 2019/0112996 A1 Apr. 18, 2019

Related U.S. Application Data

(63) Continuation of application No. 15/121,157, filed as application No. PCT/JP2015/056523 on Mar. 5, 2015, now abandoned.

(30) Foreign Application Priority Data

Apr. 16, 2014 (JP) ..... 2014-084890

(51) Int. Cl.
*F02D 41/22* (2006.01)
*F02D 41/00* (2006.01)
(Continued)

(52) U.S. Cl.
CPC ..... *F02D 41/22* (2013.01); *E02F 9/267* (2013.01); *F02D 29/02* (2013.01); *F02D 29/04* (2013.01);
(Continued)

(58) Field of Classification Search
CPC ..... F02D 41/22; F02D 29/02; F02D 29/04; F02D 41/26; F02D 41/0025; F02D 41/04;
(Continued)

(56) References Cited

U.S. PATENT DOCUMENTS 5,172,738 A * 12/1992 Komukai ..... B67D 7/0476 141/1
5,579,233 A * 11/1996 Burns ..... B67D 7/145 221/23
(Continued)

FOREIGN PATENT DOCUMENTS

JP 2006-132438 A 5/2006
JP 2008-008234 A 1/2008
(Continued)

OTHER PUBLICATIONS

International Search of PCT/JP2015/056523 dated Apr. 7, 2015.

*Primary Examiner* — Hung Q Nguyen
*Assistant Examiner* — Brian P Monahon
(74) *Attorney, Agent, or Firm* — Mattingly & Malur, PC

(57) ABSTRACT

An object of the present invention is to provide a working machine and a working machine monitoring system using the same which is capable of improving the accuracy in determining fuel property. The working machine is provided with an engine operation parameter acquisition module (1041) that acquires an engine operation parameter representing the operation state of an engine mounted on the working machine; a refueling time acquisition module (1011) that acquires a refueling time when the working machine is supplied with fuel; and a fuel property determination module (1014) that determines the property of the fuel based on a comparison result of the time when the engine operation parameter changes, with the refueling time.

2 Claims, 14 Drawing Sheets

(51) Int. Cl.

| | |
|---|---|
| ***F02D 41/04*** | (2006.01) |
| ***F02D 41/26*** | (2006.01) |
| ***F02D 29/04*** | (2006.01) |
| ***F02D 29/02*** | (2006.01) |
| ***G07C 5/00*** | (2006.01) |
| ***G07C 5/08*** | (2006.01) |
| ***E02F 9/26*** | (2006.01) |
| ***E02F 9/20*** | (2006.01) |
| ***E02F 3/32*** | (2006.01) |

(52) U.S. Cl.
CPC ..... *F02D 41/0025* (2013.01); *F02D 41/04* (2013.01); *F02D 41/26* (2013.01); *G07C 5/008* (2013.01); *G07C 5/0808* (2013.01); *G07C 5/0816* (2013.01); *G07C 5/0841* (2013.01); *E02F 3/32* (2013.01); *E02F 9/2066* (2013.01); *E02F 9/26* (2013.01); *F02D 2041/228* (2013.01); *F02D 2200/0612* (2013.01); *F02D 2200/0614* (2013.01); *F02D 2200/0618* (2013.01); *F02D 2200/602* (2013.01); *F02D 2250/26* (2013.01)

(58) Field of Classification Search
CPC ..... F02D 2200/0612; F02D 2200/0614; F02D 2200/0618; F02D 2200/602; F02D 2250/26; F02D 2041/228; G07C 5/0808; G07C 5/008; G07C 5/0816; G07C 5/0841; E02F 9/267; E02F 9/26; E02F 9/2066; E02F 3/32
See application file for complete search history.

(56) References Cited

U.S. PATENT DOCUMENTS 5,817,923 A * 10/1998 Ohsaki ..... F02D 41/064 73/35.02
6,360,726 B1 * 3/2002 Javaherian ..... F02D 41/0025 123/435
7,159,623 B1 * 1/2007 Carr ..... F02D 19/0628 123/516
2003/0149491 A1 * 8/2003 Adachi ..... E02F 9/20 700/9
2003/0191566 A1 * 10/2003 Ben-Assa ..... B67D 7/085 701/31.4
2005/0065710 A1 * 3/2005 Yasuda ..... F02D 33/003 701/114
2007/0079804 A1 * 4/2007 Nakayama ..... B60R 25/1004 123/339.15
2007/0119413 A1 5/2007 Lewis et al.
2007/0299577 A1 * 12/2007 Hattori ..... G07C 9/00309 701/29.6
2008/0051978 A1 2/2008 Yamaguchi et al.
2008/0154485 A1 * 6/2008 Yasuda ..... F01N 3/101 701/113
2009/0031704 A1 2/2009 Tanaka
2009/0139305 A1 * 6/2009 Stavrianos ..... F02D 19/0605 73/23.31
2009/0198456 A1 * 8/2009 Tsutsumi ..... F02D 41/0025 702/41
2009/0210138 A1 * 8/2009 Hokuto ..... F02D 41/0025 701/103
2010/0168983 A1 * 7/2010 Ruiz ..... F02D 41/1497 701/103
2010/0231371 A1 * 9/2010 Arakawa ..... B60K 15/04 340/450.2
2010/0312459 A1 12/2010 Utsumi
2010/0319803 A1 * 12/2010 Mowzoon ..... B67D 7/348 141/1
2012/0083994 A1 4/2012 Higuchi et al.
2012/0239276 A1 9/2012 Nishiumi
2013/0055798 A1 * 3/2013 Matsuura ..... F02D 41/182 73/114.32
2013/0239934 A1 * 9/2013 Honda ..... F02D 41/006 123/704
2015/0106204 A1 * 4/2015 Pudar ..... G06Q 30/0261 705/14.58
2015/0310678 A1 * 10/2015 Ito ..... B60Q 9/00 701/32.3

FOREIGN PATENT DOCUMENTS

JP 2009-229129 A 10/2009
JP 2011-185095 A 9/2011
JP 2012-122373 A 6/2012
JP 2012-229675 A 11/2012

* cited by examiner

WORKING MACHINE AND WORKING MACHINE MONITORING SYSTEM

TECHNICAL FIELD

The present invention relates to a work machine and a working machine monitoring system and particularly, to the property determination of fuel supplied to the working machine.

BACKGROUND ART

Diesel engines being high in torque and superior economically are the mainstream of prime movers for hydraulic excavators. Compared with gasoline engines, the diesel engines have strong robustness in combustion, and thus, it may be the case that the operation is possible even by using unprescribed fuel (kerosene, biofuel, poorly refined fuel or the like). However, if unprescribed fuel were used, assurance would not be provided in output power, fuel efficiency, exhaust gas performance and the like and at the same time, there would occur a case that the fuel constituent or the exhaust gas constituent damages various parts to finally result in a fault.

Particularly, it occurs frequently that the management in fuel is insufficient in newly rising nations and developing nations, and thus, engine faults caused by unprescribed fuel take place occasionally. Accordingly, if it is possible to detect the use of unprescribed fuel as soon as possible and to give the user a warning before the engine comes to a fault, advantages can be realized in preventing the operating rate from going down as well as in reducing the cost for maintenance.

As a technology for detecting unprescribed fuel, there is disclosed in, for example, Patent Literature 1 a technology that infers a fuel property from a detected engine operation parameter based on beforehand-calculated correlation between fuel property and the engine operation parameter. This technology determines the use of unprescribed fuel when the behavior in the engine operation parameter largely deviates from the correlation with a standard fuel property.

CITATION LIST

Patent Literature

Patent Literature 1:

United States Patent Application Publication No. 2009/031704

SUMMARY OF THE INVENTION

Technical Problem

Engine operation parameters change in dependence not only on fuel property but also on diverse factors of an engine main body. In this respect, since the technology in Patent Literature 1 grasps changes in the engine operation parameters only to determine the fuel property, it is difficult to distinguish whether an abnormality in the engine operation parameter is attributed to the fuel property or to the engine main body, and thus, there remains a problem that the accuracy in determination is not high.

The present invention has been made taking the aforementioned problem into consideration, and an object thereof is to provide a working machine and a working machine monitoring system capable of improving the accuracy in determining fuel property.

Solution to Problem

In order to achieve this object, the feature of a working machine according to the present invention includes: an engine operation parameter acquisition module that acquires an engine operation parameter representing the operation state of an engine mounted on the working machine; a refueling time acquisition module that acquires a refueling time when the working machine is supplied with fuel; and a fuel property determination module that determines the property of the fuel based on a comparison result of the time when the engine operation parameter changes, with the refueling time.

The aforementioned engine operation parameter changes in dependence on the property of fuel, and thus, where the property of fuel is not satisfactory, that is, in the case of so-called unprescribed fuel, the engine operation parameter also changes. Therefore, in comparison of the time when the engine operation parameter changes, with the refueling time, the fuel property determination module can determine whether the cause of a change in the engine operation parameter is attributed to the fuel property or not when the change in the engine operation parameters arises.

Further, the feature of the present invention resides in that in the aforementioned configuration, the fuel property determination module determines the cause of a change in the engine operation parameter as being attributed to the property of fuel if a lapsed time from a refueling of fuel is within a first time period in which an influence by the fuel property is considered to arise and if a change amount of the engine operation parameter exceeds a first threshold value.

The occurrence of a change in the engine operation parameter due to the fuel property is limited to the time subsequent to the refueling time. Further, it has experientially been known that a change in the engine operation parameter attributed to the fuel property arises at a relatively early stage after a refueling. Therefore, the accuracy in determination can further be improved by determining that the cause of a change in the engine operation parameter is attributed to the fuel property where the occurrence of a change in the engine operation parameter is after a refueling and within the first time period.

Further, the feature of the present invention resides in that in the aforementioned configuration, there is further provided an engine control module that controls the variation in output power of the engine, and if the fuel property determination module judges that a change amount of the engine operation parameter is equal to or larger than a second threshold value being larger than the first threshold value, the engine control module executes a control to lower the output power of the engine.

According to the present invention, it is possible to reduce the load against the engine by lowering the engine output power when the engine is operated by using a fuel that is not satisfactory in fuel property.

Further, the feature of the present invention resides in that in the aforementioned configuration, there is further provided a notification module that notifies an operator of the result of a determination made by the fuel property determination module.

According to the present invention, the operator of the working machine is notified of the fuel property being not satisfactory, and thus, attention in operating the working machine can be drawn to the operator.

Further, the present invention is a working machine monitoring system including a plurality of working machines and a monitoring server connected to the plurality of working machines through a network, and the feature of the system includes: an engine operation parameter acquisition module that acquires an engine operation parameter representing the operation state of an engine mounted on each of the working machines; a refueling time acquisition module that acquires a refueling time when each working machine is supplied with fuel; a fuel property determination module that determines the property of the fuel based on a result of the comparison of the time when the engine operation parameter changes, with the refueling time; terminal-side communication control modules respectively provided on the plurality of working machines for transmitting to the monitoring server individual information being information as to a property determination processing for the fuel in each working machine and a server-side communication control module that receives the individual information transmitted from the terminal-side communication control modules; and a fuel property final determination module that extracts, from the individual information for the plurality of working machines, the individual information including the refueling times of the respective working machines within a second time period which enables the same fuel to be considered as having been supplied at the same refueling timing, and that compares the extracted individual information to make a final determination as to the fuel property of each of the working machines, wherein based on the final determination result, the server-side communication control module transmits an instruction information for instructing a restriction in output power of the engine for a working machine being an object to be determined; and wherein the terminal-side communication control module provided on the working machine being the object to be determined receives the instruction information.

According to the present invention, because the final determination of the fuel property in each working machine is made in comparison of the individual information for the plurality of working machines, the final determination of the fuel property can be made as the influence caused by an abnormality that unexpectedly arises in one working machine can be lessened. Therefore, it is possible to improve the accuracy in determining the fuel property.

Advantageous Effect of Invention

According to the present invention, it is possible to provide the working machine and the working machine monitoring system using the same which are capable of improving the accuracy in determining the fuel property. Incidentally, other configurations and the like than those aforementioned will be clarified by the embodiment.

DESCRIPTION OF EMBODIMENTS

Figure 1:
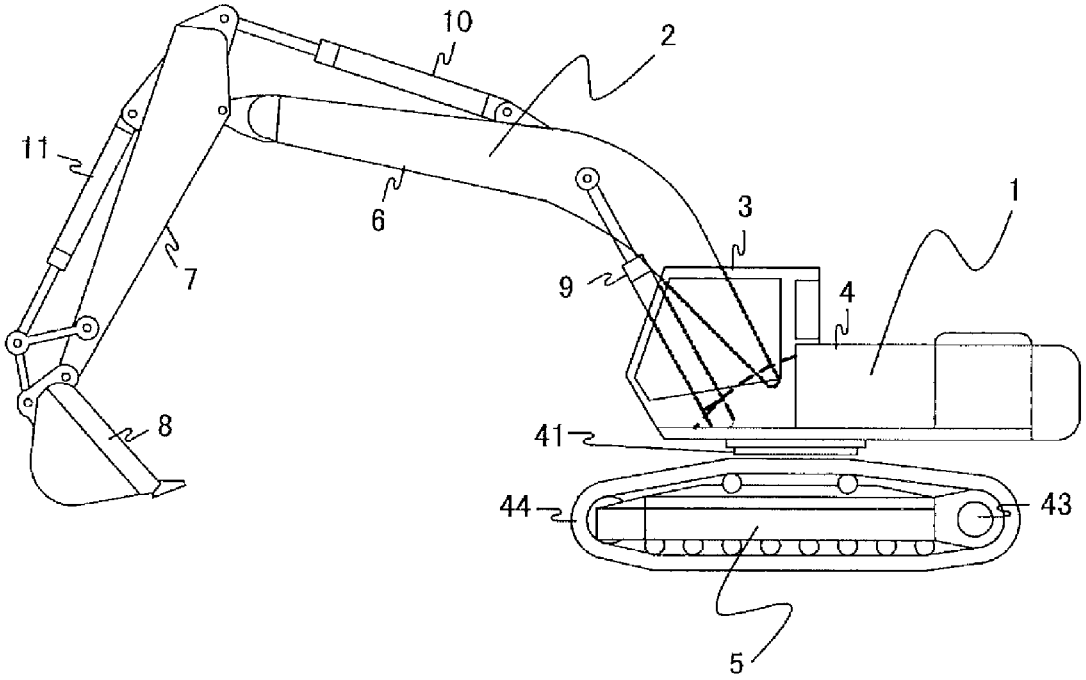
FIG. 1 is an exterior view of a hydraulic excavator (hydraulic working machine).

Hereinafter, embodiments of the present invention will be described with reference to the drawings. In the following embodiments, description will be made with a plurality of sections or embodiments divided for convenience if need be. Where reference is made to the number or the like (number, numeral, quantity, range, etc.) of elements, except for the case where an express statement is given or where the limitation to a specified number is theoretically obvious, the number is not limited to the specified number and may be more than or less than the specified number. Incidentally, in the following embodiments, the component (including the process step and the like) is not necessarily essential except for the case where an express statement is given or where the component is considered to be theoretically plainly essential.

Further, respective configurations, functions, processing modules, processing means and the like may be realized in the form of, for example, integrated circuits and other hardware in part or as a whole. Further, respective configurations, functions, processing modules, processing means and the like referred to later may be realized in the form of programs executed in a computer. In other words, they may be realized in the form of software. Information on programs, tables, files and the like that realize the respective configurations, functions, processing modules, processing means and the like can be stored in storage units such as memories, hard discs, SSD (Solid State Drive) and the like and also in storage mediums such as IC cards, SD cards, DVD and the like. Hereafter, the embodiments of the present invention will be described with reference to the drawings. Throughout all of the drawings, the same component will be given an identical reference numeral, with which duplication in description will be omitted.

First Embodiment

The first embodiment is an embodiment in which a determination processing for fuel property is executed in individual working machines. Hereafter, the first embodiment will be described with reference to FIG. 1 through FIG. 11. Although description will hereafter be made taking a hydraulic excavator as one example of a working machine, the working machine is not limited to a hydraulic excavator.

FIG. 1 shows an exterior view of a hydraulic excavator (hydraulic working machine). The hydraulic excavator 1 is composed of a multiply articulated working mechanism 2 including a boom 6, an arm 7 and a bucket 8 that are each pivotable in a vertical direction, and a vehicle body 3 including a revolving upperstructure 4 and an undercarriage 5. A base end of the boom 6 in the working mechanism 2 is supported at a front end of the revolving upperstructure 4 to be pivotable in an upward-downward direction. The boom 6, the arm 7 and the bucket 8 respectively have a boom cylinder 9, an arm cylinder 10 and a bucket cylinder 11 connected therewith mechanically, and the boom cylinder 9, the arm cylinder 10 and the bucket cylinder 11 are driven by hydraulic mechanisms. The revolving upperstructure 4 and the undercarriage 5 are mechanically coupled through a center joint 41. The undercarriage 5 is configured to include a travel reduction gear 43 and crawlers 44.

Figure 2:
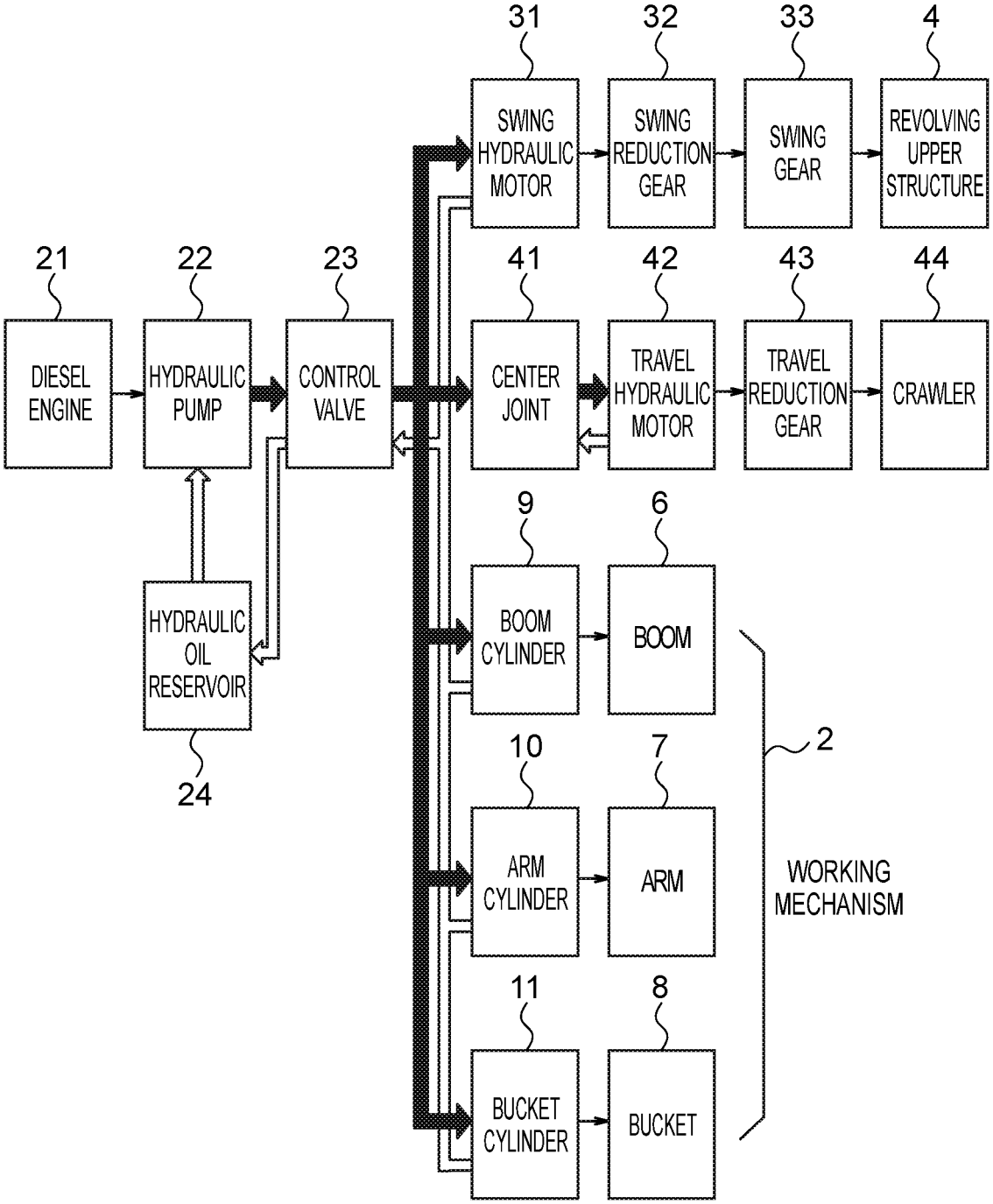
FIG. 2 is a block diagram showing the system configuration of the hydraulic excavator.

Next, the entire system configuration of the hydraulic excavator 1 will be described with reference to FIG. 2. FIG. 2 is a block diagram showing the system configuration of the hydraulic excavator. A diesel engine 21 and a hydraulic pump 22 are mechanically coupled to drive the hydraulic pump 22 by the Diesel engine 21. The hydraulic pump 22 compresses hydraulic oil fed from a hydraulic oil reservoir 24 to generate pressurized oil and feeds the same to a control valve 23. Based on operation commands from an operator, the control valve 23 distributes the pressurized oil that are necessary for travel operation, revolving upperstructure operation and working mechanism operation and returns unnecessary pressurized oil to the hydraulic oil reservoir 24.

A swing hydraulic motor 31 takes the pressurized oil distributed from the control valve 23 as a power source and drives the revolving upperstructure 4 through a swing reduction gear 32 and a swing gear 33. The travel hydraulic motor 42 uses the pressurized oil fed from the control valve 23 by way of the center joint 41 to drive the crawlers 44 through the travel reduction gear 43. Further, the working mechanism 2 drives the boom cylinder 9, the arm cylinder 10 and the bucket cylinder 11 based on the pressurized oil distributed from the control valve 23 and controls the boom 6, the arm 7 and the bucket 8 to perform desired motions respectively.

Figure 3:
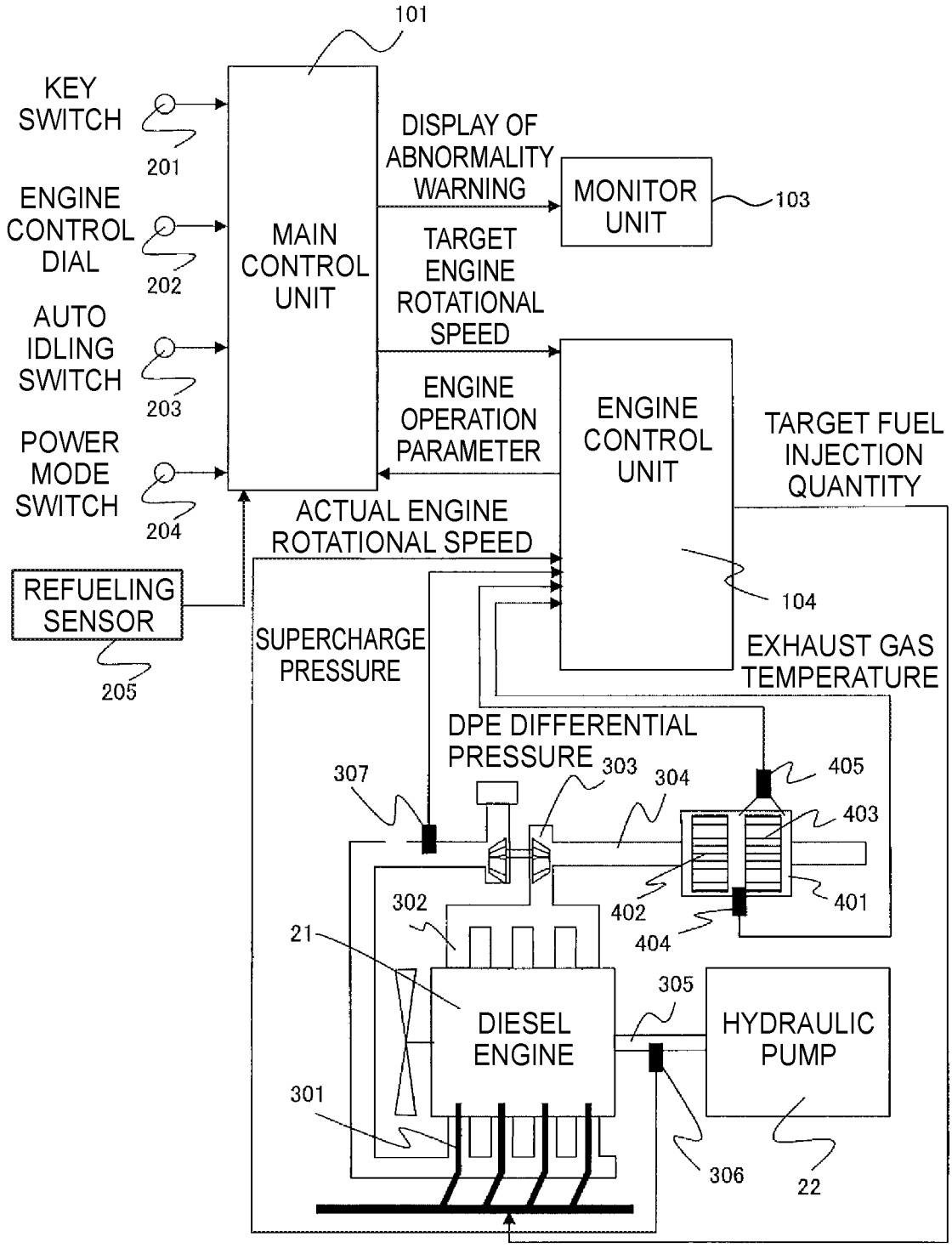
FIG. 3 is an illustration showing an engine for the hydraulic excavator and a system configuration therearound according to a first embodiment.

FIG. 3 is an illustration showing an engine for the hydraulic excavator and a system configuration therearound according to the first embodiment. The diesel engine 21 as a power source for driving the hydraulic pump 22 is directly coupled with the hydraulic pump 22 at an output shaft 305. The diesel engine 21 is controlled by an engine control unit 104. As other control units, there exist a main control unit 101 that directs the nucleuses of the hydraulic excavator 1, and a monitor unit 103 that supplies the operator with information relating to the hydraulic pressure and the engine, and these units are mutually connected by an information network (signal lines).

The main control unit 101 taking part in the engine control receives information inputs from a key switch 201 taking charge of the start and stop of the engine, an engine control dial 202 designating the rotational speed of the engine, an auto idling switch 203 for optimizing the idling rotational speed, a power mode switch 204 for adjusting the output power of the engine, and a refueling sensor 205. The main control unit 101 calculates a target engine rotational speed based on these information and transmits the target engine rotational speed to the engine control unit 104. Further, the main control unit 101 utilizes the information from the refueling sensor 205 and makes a determination of fuel property according to the present invention. The monitor unit 103 displays the result of a determination where anything unusual occurs.

The engine control unit 104 controls the engine rotational speed by directing a target fuel injection quantity to a fuel injector 301 based on the difference between a target rotational speed transmitted from the main control unit 101 and an actual engine rotational speed detected by a rotation sensor 306.

The diesel engine 21 according to the present embodiment is provided with the fuel injector 301 of an electronic control type, an exhaust manifold 302, a turbocharger 303, and a DPF (Diesel Particulate Filter) device 401 being one kind of exhaust gas purifiers. The DPF device 401 is installed in an exhaust pipe 304 and is configured to include an oxidation catalyst 402 disposed on an upstream side and a filter (that collects particulate matter contained in the exhaust gas) disposed on a downstream side. Further, as sensors relating to the DPF device 401, there are arranged an exhaust gas temperature sensor 404 for detecting the temperature of the exhaust gas and a DPE differential pressure sensor 405 for detecting the front-rear differential pressure (pressure loss at the filter) between the upstream side and the downstream side of the filter 403. By using information from the DPE differential pressure sensor 405, it is possible to infer the quantity of PM (Particulate Matter) deposited on the filter 403. Further, a supercharge pressure sensor 307 is attached to the diesel engine 21.

Incidentally, the fuel injection timing is adjusted by the fuel injector 301, and this causes the exhaust gas to rise in temperature, so that the PM deposited on the filter is burned and removed to revive the filter function. The present revivification control is executed in an automatic revivification mode or a manual revivification mode, and the engine control unit 104 determines which mode is to be selected, based on information indicated by various signals from the rotation sensor 306, the exhaust gas temperature sensor 404, the DPE differential pressure sensor 405 and the like and executes automatic revivification or requests manual revivification to the operator.

The rotation sensor 306, the supercharge pressure sensor 307, the exhaust gas temperature sensor 404, and the DPE differential pressure sensor 405 are connected to the engine control unit 104, and information from these sensors is inputted to the engine control unit 104. The information inputted is used for a fuel property determination processing according to the present invention. The details will be described later.

Figure 4:
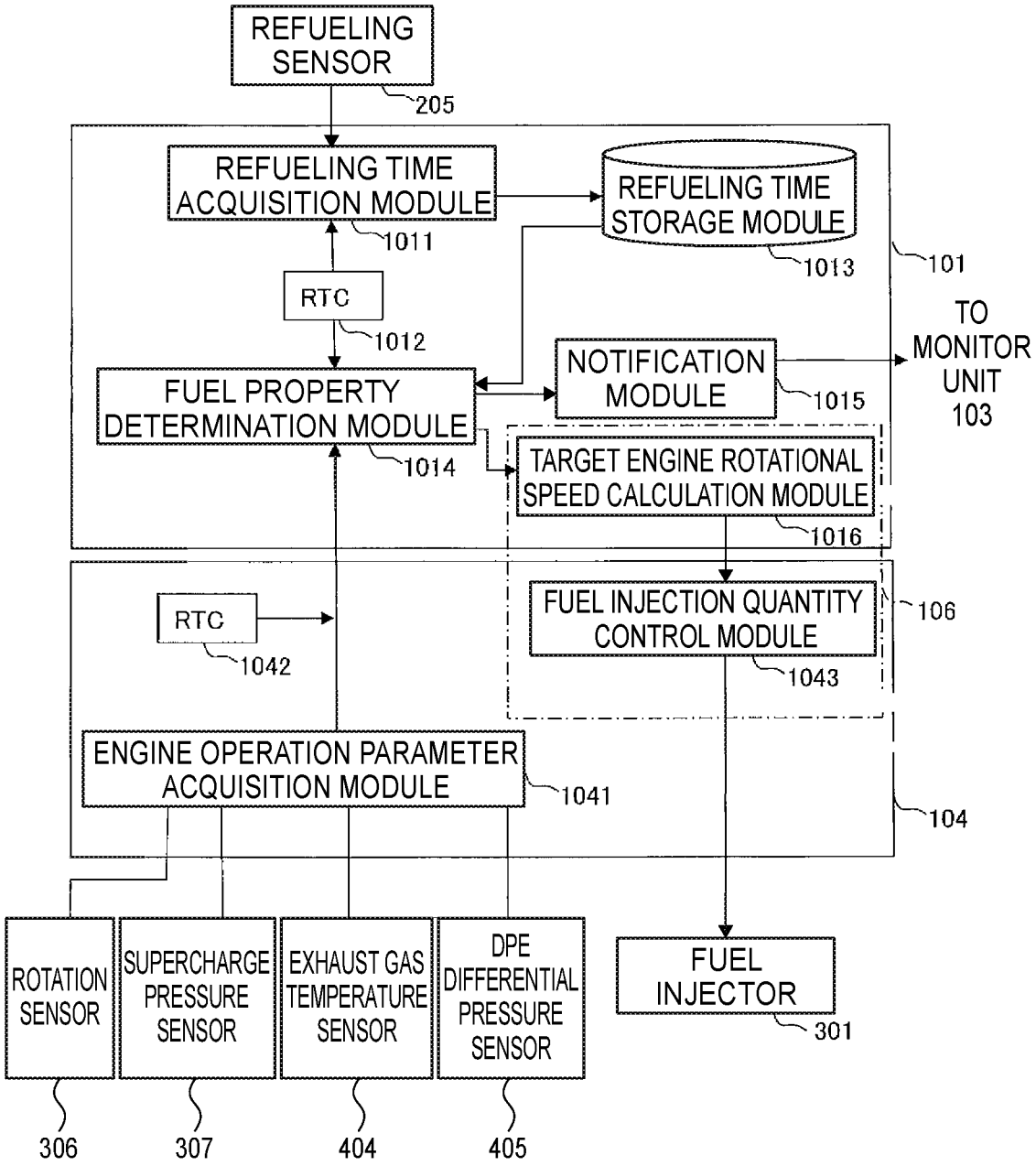
FIG. 4 is a block diagram showing the function configuration for a fuel property processing according to the first embodiment.

Next, functions regarding the fuel property processing according to the first embodiment will be described with reference to FIG. 4. FIG. 4 is a block diagram showing the function configuration for the fuel property processing according to the first embodiment.

The main control unit 101 includes a refueling time acquisition module 1011, an RTC (Real Time Clock) 1012 as timing means, a refueling time storage module 1013, a fuel property determination module 1014, a notification module 1015, and a target engine rotational speed calculation module 1016.

The refueling time acquisition module 1011 acquires a refueling time at which refueling the hydraulic excavator 1 is completed. In the present embodiment, the refueling time acquisition module 1011 determines the present/absence of a refueling based on a detection signal from the refueling sensor 205 and, when determining the refueling as being present, acquires a refueling time based on the time information from the RTC 1012.

The refueling time storage module 1013 fixedly stores the acquired refueling time. "Being fixedly" mentioned herein means the duration up to the completion of the determination of the fuel property and thus, when becoming unnecessary, the refueling time may be deleted from the refueling time storage module 1013. Further, the refueling time storage module 1013 also accepts the processing that overwrites the stored refueling time with a new refueling time.

The fuel property determination module 1014 determines the fuel property based on the result of a comparison between the time when the engine operation parameter changes, and the refueling time. Details will be described later.

The notification module 1015 makes the monitor unit 103 display the determination result of the fuel property determination module 1014 if the fuel property is not satisfactory, that is, in the case of unprescribed fuel. Thus, attention is drawn to the operator in using unprescribed fuel.

The target engine rotational speed calculation module 1016 calculates a target engine rotational speed for restricting the engine output power in dependence on the quality of the fuel property.

The engine control unit 104 is provided with an engine operation parameter acquisition module 1041, an RTC 1042, and a fuel injection quantity control module 1043. The engine operation parameter acquisition module 1041 acquires engine operation parameters such as, for example, rotational speed, supercharge pressure, exhaust gas temperature and DPE differential pressure that represent the operation state of the engine mounted on the hydraulic excavator 1. The fuel injection quantity control module 1043 calculates a target fuel injection quantity that satisfies a target engine rotational speed. Then, the control module 1043 outputs a signal indicative of the target fuel injection quantity to the fuel injector 301. The aforementioned target engine rotational speed calculation module 1016 and fuel injection quantity control module 1043 are named generally as an engine control module 106.

The refueling time acquisition module 1011, the fuel property determination module 1014, the notification module 1015, the target engine rotational speed calculation module 1016, the engine operation parameter acquisition module 1041 and the fuel injection quantity control module 1043 that are all aforementioned are configured by the cooperation of an MPU (Micro-Processing Unit) with a program that is executed by the MPU to realize the aforementioned configurations or by dedicated chips that realize the aforementioned respective functions. Further, the refueling time storage module 1013 is configured by the cooperation of a storage device such as an EEPROM (Electrically Erasable Programmable ROM) with an arithmetic unit and a program that control the reading and writing with respect to the storage device.

Figure 5:
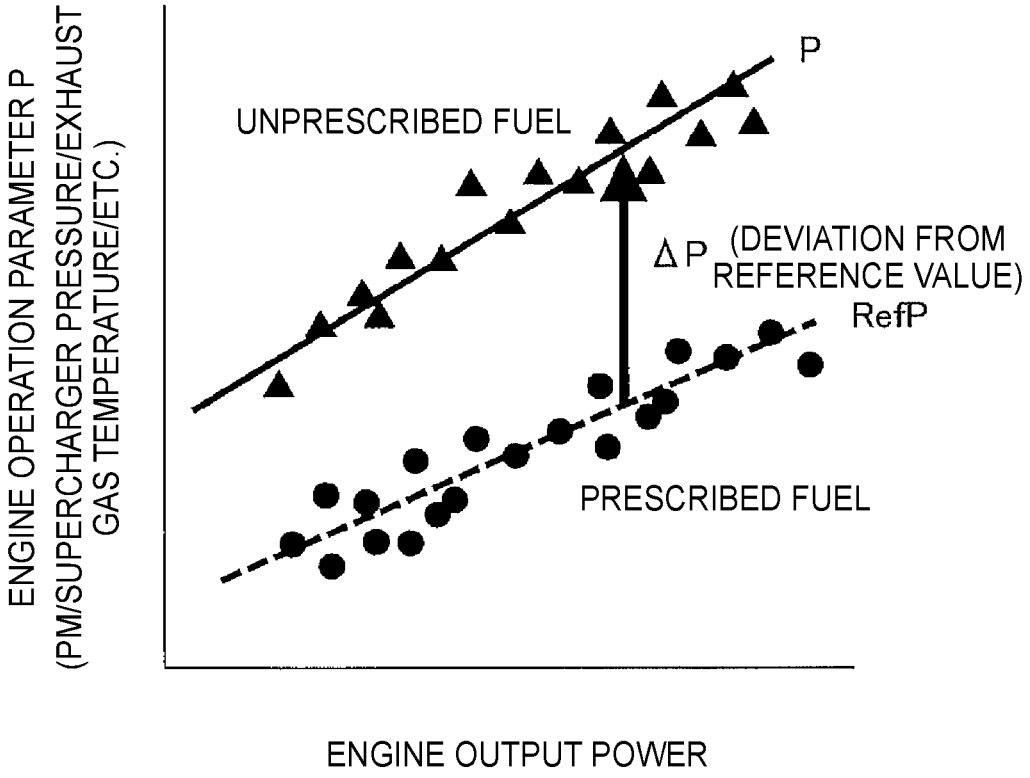
FIG. 5 is a graph showing the relation between engine operation parameter correlating to fuel property and engine output power.
Figure 6A:
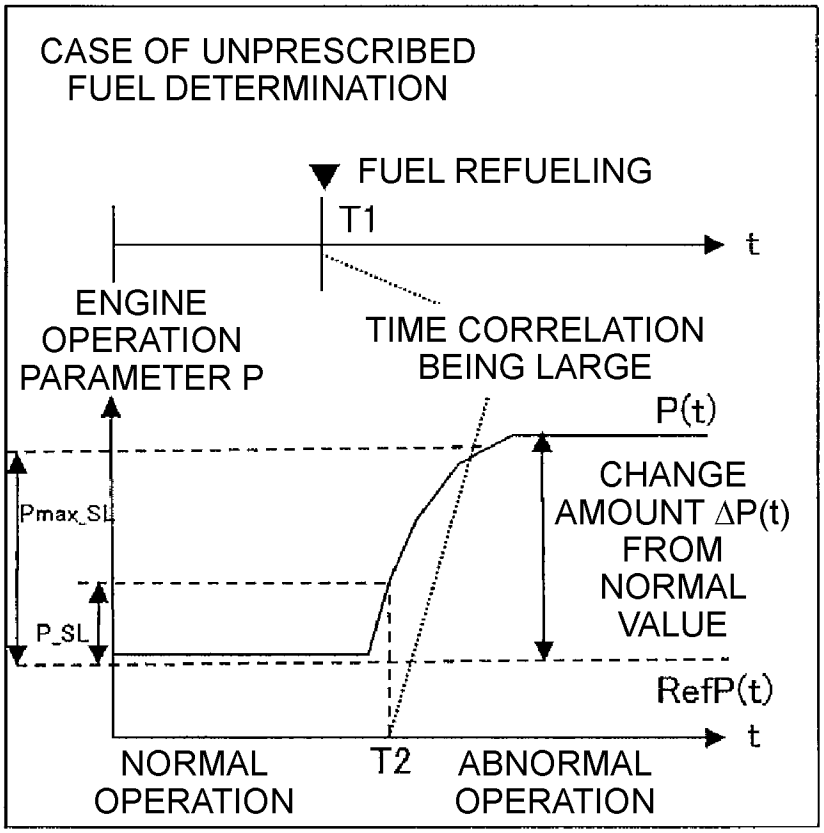
FIG. 6 relate to charts that show determination areas for unprescribed fuel in connection with an engine operation parameter (PM), wherein FIG. 6(*a*) shows the case of being determined as unprescribed fuel and FIG. 6(*b*) shows the case of out-of-determination.
Figure 6B:
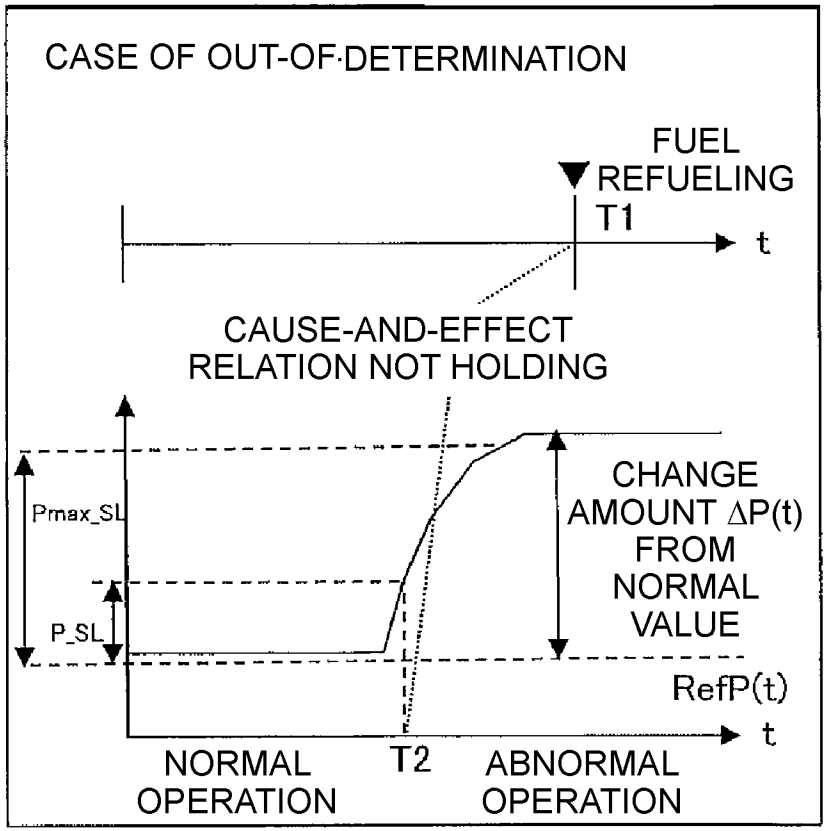

Next, the basic logic of the fuel property determination in the first embodiment will be described with reference to FIG. 5 and FIG. 6. FIG. 5 is a graph showing the relation between engine operation parameters correlating to fuel property and engine output power. Herein, the engine operation parameters are defined as parameters relating to output power, exhaust gas, temperature and the like that change every moment during the operation of the engine. In FIG. 5, PM, supercharge pressure, exhaust gas temperature and the like are chosen as the engine operation parameters.

Where the engine is in order and the fuel is prescribed fuel, the dispersion in the values of these engine operation parameters at each output power comes into a predetermined range (refer to the prescribed fuel graph in FIG. 5). In the case of unprescribed fuel, the values of the engine operation parameters tend to deviate from the aforementioned range (refer to the unprescribed fuel graph in FIG. 5). Accordingly, by checking whether or not the engine operation parameter values come in a predetermined range corresponding to prescribed fuel, it is possible to determine whether the fuel is prescribed one or unprescribed one.

However, the aforementioned determination of the fuel property involves the following problem. The engine operation parameters being indies for determination changes due to various factors. For example, even where the fuel is prescribed one, the occurrence of a fault even at a part of the engine main body causes the engine operation parameter to deviate from a normal value (FIG. 5 shows this deviation amount as a deviation $\Delta P$ from a reference value). That is, only by grasping the changes in the engine operation parameters, it is difficult to discriminate whether the deviation is attributed to the fuel property or to the engine main body, so that an error determination is possible to arise.

Accordingly, in the first embodiment, as judgment information for the fuel property determination, refueling time information is added in addition to the engine operation parameters. A way of basic thinking for a fuel property determination logic is indicated in FIG. 6. FIG. 6 relate to charts that show determination areas for unprescribed fuel in connection with an engine operation parameter (PM), wherein FIG. 6(*a*) shows the case of being determined as unprescribed fuel and FIG. 6(*b*) shows the case of being an out-of-determination.

First of all, a refueling time is stored as T1. The refueling time may regard as a refueling time the time when the residual quantity of the fuel increases, or may be taken by the means for attaching a fuel cap with an open/close sensor. Alternatively, where refueling time information is given from gas stations, such information may be utilized.

Then, an engine operation reference parameter RefP(t) that becomes the reference for prescribed fuel is stored in advance, and the time when the engine operation parameter P(t) deviates from the RefP(t) is checked and stored as T2. The determination criterion for deviation is that the deviation $\Delta P$ between the value of the engine operation parameter P(t) and the engine operation reference parameter RefP(t) becomes equal to higher than a first threshold value P_SL being the level that enables unprescribed fuel to be regarded as being in use. In FIG. 6, the time when the engine operation parameter P(t) deviates is indicated by T2.

Then, the relation between the stored T1 and T2 is considered, a judgment is made of whether a cause-and-effect relation holds true between the both or not, and if the cause-and-effect relation holds true, a determination is made as unprescribed fuel. For example, in the case of FIG. 6(*a*), because the deviation time T2 of the engine operation parameter comes right after the refueling time T1, the possibility is judged to be high that the engine operation parameter has changed by the cause of unprescribed fuel, and thus, a determination is made as unprescribed fuel being in use. On the contrary, in the case of FIG. 6(*b*), because the refueling time T1 has come behind the engine operation parameter deviation time T2, the cause of the engine operation parameter deviation can be judged not to be attributed to unprescribed fuel, and thus, there is not made a determination that unprescribed fuel is in use.

Like this, in inferring the fuel property from the engine operation parameter, the correlation between the time when the engine operation parameter changes, and the refueling time is taken into account to make a final determination of the fuel property, so that the accuracy in the determination can be improved to make it possible to prevent the occurrence of an erroneous determination. Incidentally, although being in dependence on the residual quantity in the fuel reservoir at the time of a refueling, the influence attributed to the refueling of unprescribed fuel arises in a few minutes or a few hours, for example, in a period of five minutes to one hour or so. With this, the engine operation parameter changes. The magnitude of the aforementioned influence is determined based on the magnitude of the deviation ΔP.

Figure 7:
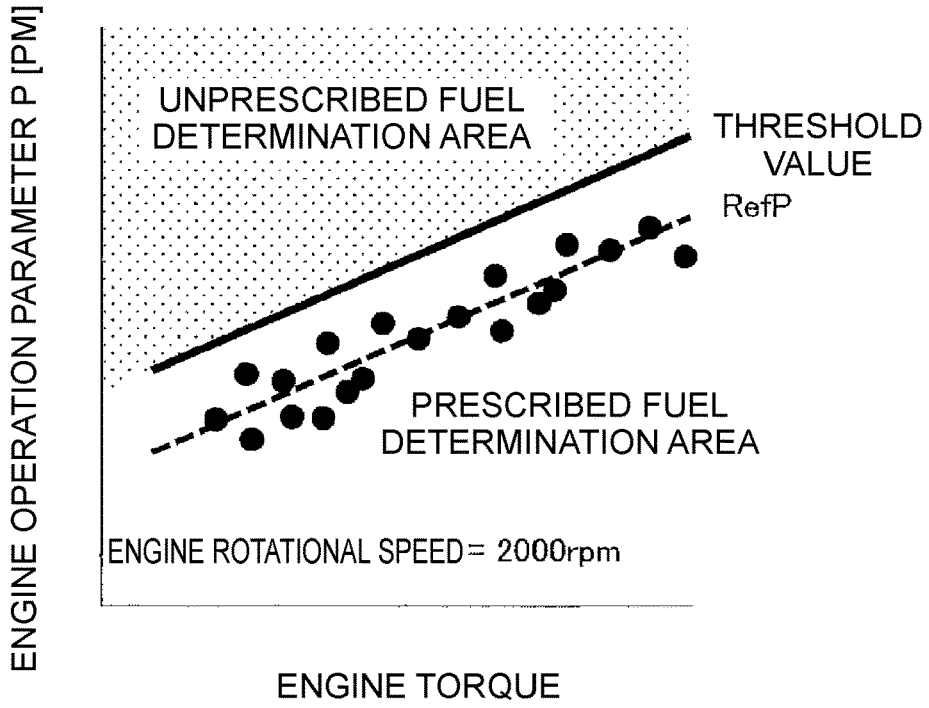
FIG. 7 is a chart that shows a determination area for unprescribed fuel in connection with an engine operation parameter (NOx).

Next, with reference to FIG. 7 through FIG. 10, description will be made regarding the engine operation parameters used in fuel property determination. FIG. 7 is a chart that shows a determination area for unprescribed fuel in connection with an engine operation parameter (NOx). The content of NOx can be grasped by examining the distribution quantity of PM being one kind of exhaust constituent. It is possible to infer the distribution quantity of PM based on the DPE differential pressure sensor 405 and the like.

Where the engine torque is changed with the engine rotational speed kept fixed, the distribution quantity of PM comes in a predetermined range at the time of prescribed fuel being in use, but, at the time of unprescribed fuel being in use, tends to exceed the aforementioned range by the cause of foreign matter in the fuel. Accordingly, it is done to use the distribution quantity of PM as the engine operation parameter, to set threshold values (defined by the distribution quantities of PM) suitable for respective operation states (defined by the engine torques), and to define as unprescribed fuel area the case that the engine operation parameter becomes equal to or higher than the threshold value with a certain engine torque held. Thus, it is possible to use the relation between PM and the operation state as a judgment basis for a fuel property determination logic. Incidentally, since NOx increases as the outdoor temperature rises and also changes with a difference in altitude, the aforementioned range may suitably be altered in dependence on the outdoor temperature or the altitude.

Figure 8:
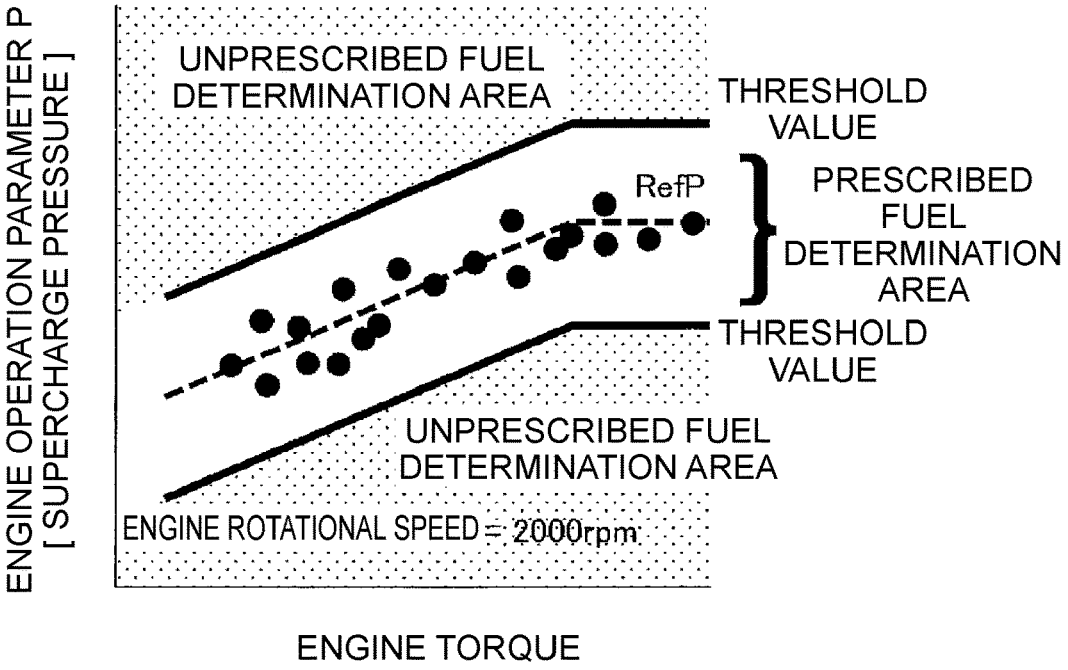
FIG. 8 is a chart that shows determination areas for unprescribed fuel in connection with an engine operation parameter (supercharge pressure).

Further, with reference to FIG. 8, description will be made regarding a determination criterion where a supercharge pressure is used as the engine operation parameter. FIG. 8 is a chart that shows determination areas for unprescribed fuel in connection with an engine operation parameter (supercharge pressure). Like the case of PM, in the case of prescribed fuel being in use, the distribution of supercharge pressures comes in a predetermined range in response to the operation state, while in the case of unprescribed fuel being in use, the combustion state changes due to the constituent of the fuel, whereby the supercharge pressure tends to exceed or fall below the aforementioned range. Accordingly, supercharge pressure ranges suitable for respective operation states (defined by the engine torques) are set, and the outside of the ranges are defined as unprescribed fuel areas. Thus, it is possible to use the relation between the supercharge pressure and the operation state as a judgment basis for the fuel property determination logic.

Figure 9:
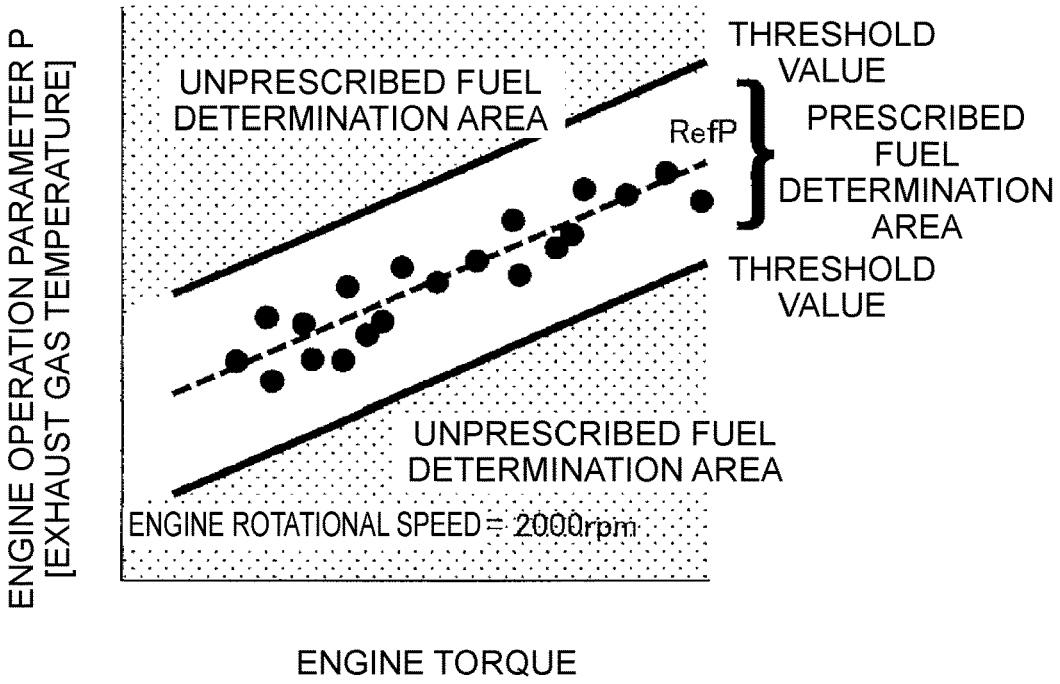
FIG. 9 is a chart that shows determination areas for unprescribed fuel in connection with an engine operation parameter (exhaust-gas temperature).

Next, with reference to FIG. 9, description will be made regarding a determination criterion where the exhaust gas temperature is used as the engine operation parameter. FIG. 9 is a chart that shows determination areas for unprescribed fuel in connection with an engine operation parameter (exhaust-gas temperature). In the case of prescribed fuel being in use, the distribution of exhaust gas temperatures comes in a predetermined range, while in the case of unprescribed fuel being in use, the distribution of exhaust gas temperatures tends to deviate from the aforementioned range due to foreign matter or the like in the fuel. Accordingly, ranges for the exhaust gas temperature are set in correspondence to respective operation states (defined by the engine torque), and the outside of the ranges is defined as unprescribed fuel areas. Thus, it is possible to use the relation between the exhaust gas temperature and the operation state as a judgment basis for the fuel property determination logic.

Figure 10:
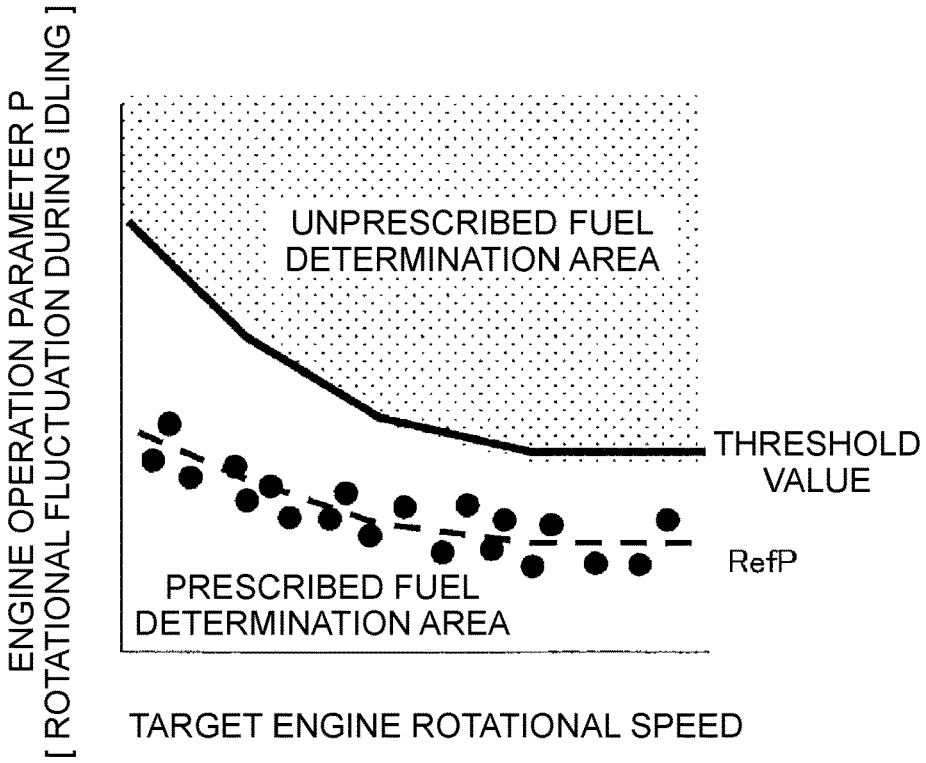
FIG. 10 is a chart that shows a determination area for unprescribed fuel in connection with an engine operation parameter (rotational fluctuation during an idling).

Lastly, with reference to FIG. 10, description will be made regarding a determination criterion where the fluctuation in the rotational speed is used as the engine operation parameter. FIG. 10 is a chart that shows a determination area for unprescribed fuel in connection with an engine operation parameter (rotational fluctuation during an idling). When a target engine rotational speed during an idling control is changed, the distribution of rotational fluctuations during idling comes in a predetermined range in the case of prescribed fuel being in use, but tends to exceed the aforementioned range due to the foreign matter in the fuel in the case of unprescribed fuel being in use. Accordingly, threshold values suitable for respective operation states (defined by the target engine rotational speed) are set, and the range being equal to or hider than the threshold value is defined as an unprescribed fuel range. Thus, it is possible to use the relation between rotational fluctuation during an idling and the operation state as a judgment basis for the fuel property determination logic.

Although the examples of the engine operation parameter have been mentioned heretofore, the engine operation parameter applicable to the present invention, without being limited to those aforementioned, may utilize another exhaust constituent (NOx, HC, CO), cylinder pressure, turbine rotational speed or the like.

Figure 11:
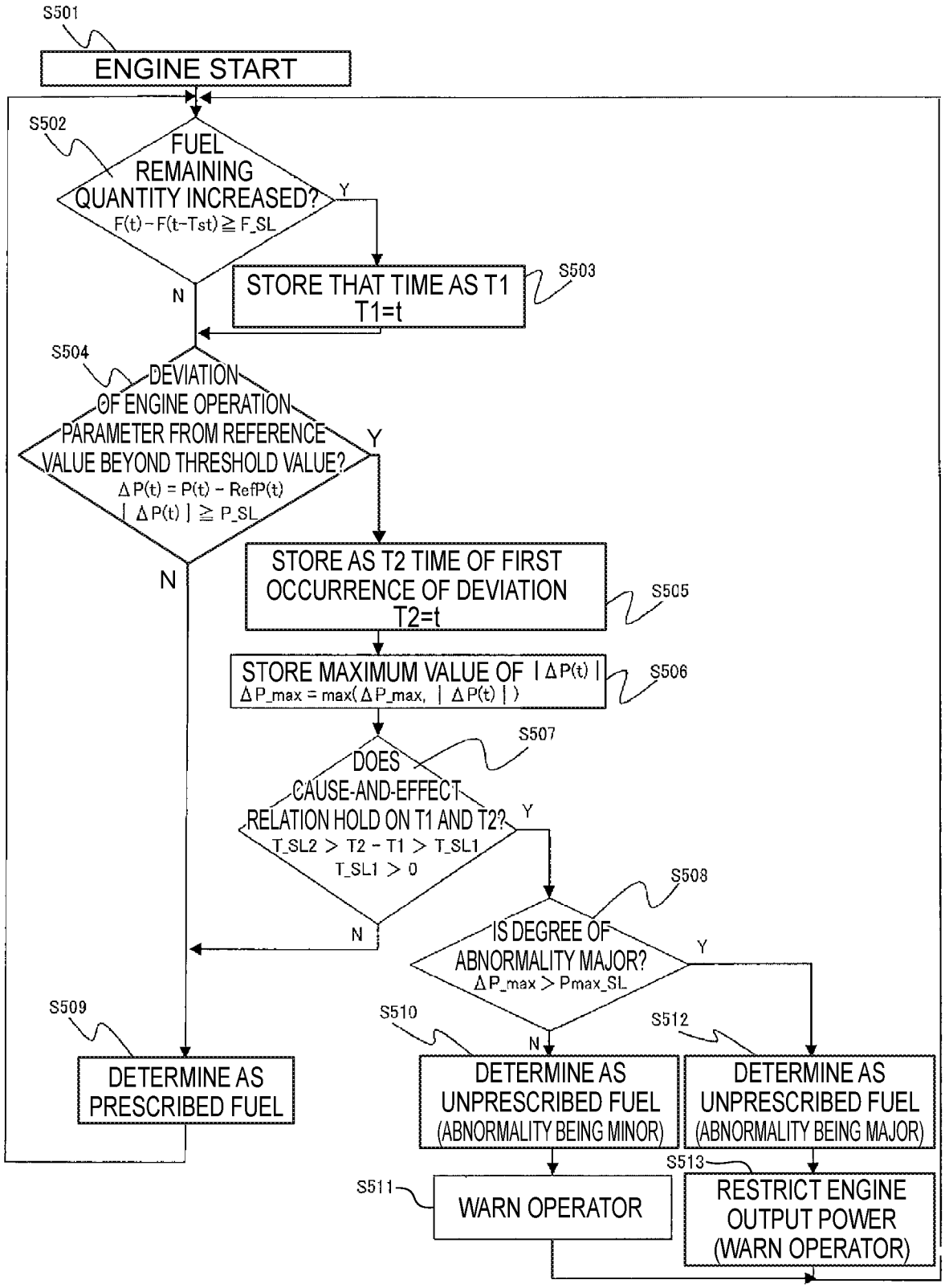
FIG. 11 is a flowchart showing an arithmetic processing for a fuel property determination logic according to the first embodiment.

Next, with reference to FIG. 11, description will be made regarding the flow of an arithmetic processing for the fuel property determination logic in the first embodiment. FIG. 11 is a flowchart showing the arithmetic processing for the fuel property determination logic according to the first embodiment.

When the arithmetic operation begins with the start of the engine at computation step S501 (S501), the refueling time acquisition module 1011 determines whether the refueling is being done or not (S502). In the present embodiment, as the refueling sensor 205, there is used a fuel remaining quantity meter that measures the fuel remaining quantity in the fuel reservoir (not shown) to output its value. The detection value of the fuel remaining quantity meter is inputted to the main control unit 101.

The refueling time acquisition module 1011 defines the fuel remaining quantity at the present time as F(t), the fuel remaining quantity before a predetermined time (Tst) as F(t−Tst), and a fuel refueling determination threshold valve as F_SL and executes an operation under the following arithmetic expression (1) to determine whether the fuel remaining quantity has increased or not.

$$F(t)-F(t-Tst)\geq F_SL \quad (1)$$

By providing the fuel refueling determination threshold valve F_SL, the refueling time acquisition module 1011 determines that refueling has been done only when fuel has increased by a predetermined quantity or more within a relatively short period of time, so that it becomes easier to exclude the situation that the fuel remaining quantity meter erroneously detects an increase in the remaining quantity due to the change in posture of the hydraulic excavator 1 at, for example, a slanted site.

At computation step S502, if the arithmetic expression (1) does not hold true (S502/No), the processing proceeds to computation step S504. If the arithmetic expression (1) holds true and the fuel remaining quantity is determined to have increased (that is, refueling has been done) (S502/Yes), the processing proceeds to computation step S503.

At the computation step S503, the refueling time acquisition module 1011 refers to the RTC 1012 for time information and stores the time (t) when the arithmetic expression (1) holds true, in the refueling time storage module 1013 as a refueling timing T1 as indicated in the following expression (2).

$$T1=t \quad (2)$$

Thereafter, the processing proceeds to the computation step S504 (S503).

At the computation step S504, the fuel property determination module 1014 determines whether or not the engine operation parameter has deviated from the reference value corresponding to prescribed fuel (S504). Specifically, after the engine start, the engine control unit 104 has inputted thereto signals from the rotation sensor 306, the supercharge pressure sensor 307, the exhaust gas temperature sensor 404 and the DPF differential pressure sensor 405. The engine operation parameter acquisition module 1041 in the engine control unit 104 chooses and acquires a signal (engine operation parameter) that is set beforehand to be used in the fuel property determination processing, from those signals inputted thereto. Then, the engine operation parameter acquisition module 1041 refers to the RTC 1042 for time information and outputs the engine operation parameter together with the time information added thereto to the fuel property determination module 1014.

The fuel property determination module 1014 defines at a certain time t the engine operation parameter as P(t), the engine operation reference parameter as RefP(t), an engine operation parameter reference value deviation being the difference between the both as ΔP(t), and a threshold value used in determining the deviation from the reference value as P_SL and executes the following arithmetic expressions (3) and (4) to determine whether the value of the engine operation parameter has deviated from the reference value corresponding to prescribed fuel.

$$\Delta P(t)=P(t)-\mathrm{Ref}P(t) \quad (3)$$

$$|\Delta P(t)|\geq P_SL \quad (4)$$

If the arithmetic expression (4) does not hold true at the computation step S504 (S504/No), the processing proceeds to computation step S509. If the arithmetic expression (4) holds true (S504/Yes) to determine that the engine operation parameter has deviated from the reference value corresponding to prescribed fuel, the processing proceeds to computation step S505.

At the computation step S505, the fuel property determination module 1014 refers to the RTC 1012 for time information and stores the time t at which the arithmetic expression (4) has held true, as time T2 at which the deviation of the engine operation parameter from the reference value occurs (hereafter referred to as "parameter abnormality timing"), in the refueling time storage module 1013 as shown in the following expression (5).

$$T2=t \quad (5)$$

The processing proceeds to computation step S506 (S505).

At the computation step S506, the fuel property determination module 1014 updates the maximum value of the absolute value |ΔP(t)| of the engine operation parameter reference value deviation ΔP(t) and stores the updated value as ΔP_max. Specifically, the fuel property determination module 1014 executes the following arithmetic expression (6), $$\Delta P_\max=\max(\Delta P_\max,|\Delta P(t)|) \quad (6)$$

and then, the processing proceeds to computation step S507 (S506).

At the computation step S507, the fuel property determination module 1014 compares the fuel refueling time T1 with the parameter abnormality timing T2 to determine whether a cause-and-effect relation holds true or not. As a condition that the cause-and-effect relation holds true, it is given as an example that the T2 occurs after the T1 and the time difference between the T1 and the T2 is within a predetermined range (from T_SL1 to T_SL2). Therefore, the fuel property determination module 1014 utilizes as the determination basis whether the following arithmetic expressions (7) and (8) hold true or not (S507).

$$T_SL2>T2-T1>T_SL1 \quad (7)$$

$$T_SL1>0 \quad (8)$$

If the arithmetic expressions (7) and (8) do not hold true at the computation step S507 (S507), the processing proceeds to computation step S509. If the arithmetic expressions (7) and (8) hold true, the fuel property determination module 1014 judges that the use of unprescribed fuel is high in possibility, and the processing proceeds to computation step S508.

At the computation step S508, in order to determine the degree of abnormality of the unprescribed fuel, the fuel property determination module 1014 calculates arithmetic expression (9) in connection with the maximum value ΔP_max of the engine operation parameter reference value deviation (S508).

$$\Delta P_\max>P\max_SL \quad (9)$$

The processing proceeds to computation step S510 if the arithmetic expression (9) does not hold true (S508/No), that is, if the ΔP_max does not exceeds the threshold value Pmax_SL, but proceeds to computation step S512 if the arithmetic expression (9) holds true (S508/Yes).

If reaching the computation step S509, the fuel property determination module 1014 determines, "The fuel in use is prescribed fuel". Then, return is made to the computation step S502, so that the fuel property determination processing is continuously executed until the engine is stopped.

If reaching the computation step S510, the fuel property determination module 1014 determines, "The fuel in use is unprescribed fuel (abnormality is minor)" (S510). Then, at computation step S511, the notification module 1015 makes the monitor unit 103 display the determination result to warn the operator. (S511).

If reaching the computation step S512, the fuel property determination module 1014 determines, "The fuel in use is unprescribed fuel (abnormality is major)" (S510). Then, at computation step S513, the determination result from the fuel property determination module 1014 is outputted to the target engine rotational speed calculation module 1016. The target engine rotational speed calculation module 1016 calculates a target engine rotational speed to lower the engine output power and outputs the target engine rotational speed to the fuel injection quantity control module 1043. The fuel injection quantity control module 1043 calculates a fuel injection quantity (target fuel injection quantity) for realizing the target engine rotational speed and outputs the fuel injection quantity to the fuel injector 301. The fuel injector 301 injects the target fuel injection quantity calculated as above, whereby the engine output power falls. With the falling of the engine output power, the notification module 1015 makes the monitor unit 103 display the determination result (the abnormality is major) to warn the operator (S513). Further, the notification may be given as a voice notification by means of a warning sound or utterance.

Further, following the computation step S511 or the computation step S513, return is made to the computation step S504, wherein the calculation for the deviation of the engine operation parameter is continuously executed.

Incidentally, the various threshold values (Tst, P_SL, T_SL1, T_SL2, Pmax_SL) that are used in the arithmetic operation flow may be set to be variable in dependence not only on the operation state but on the magnitude of the refueling quantity and the operation hour of the hydraulic excavator, so that the threshold values may be optimized. Further, the fuel property determination result may be transmitted to the owner or an administration company in addition to the operator. Further, where the degree in abnormality of unprescribed fuel is very large, there may be taken a measure to discontinue the engine.

According to the present embodiment, in inferring the fuel property from the engine operation parameter, the refueling time information is also taken into account, and thus, the influence attributed to the engine main body can be separated, so that the accuracy in inferring the fuel property determination can be improved. Further, because the fuel property is determined to warn the user that unprescribed fuel is being in use, it is expected to avoid the fault in the engine attributed to unprescribed fuel. Therefore, it can be anticipated that the operating rate of the hydraulic excavator is prevented from being lowered and that an advantageous effect is realized in reducing the maintenance cost.

Second Embodiment

Next, a second embodiment of the present invention will be described with reference to FIG. 12 through FIG. 15. In the first embodiment, the fuel property determination is executed independently for the individual of the hydraulic excavator. However, where depending on the individual independent information only, there remains a problem as before that a determination error is possible to occur in the case of an individual or the like which is few in the number of refueling times. Therefore, in the second embodiment, the amount of information is increased by gathering information from respective individuals to a center server 105, after which a majority rule processing or the like is executed to make the fuel property determination more accurately.

Figure 12:
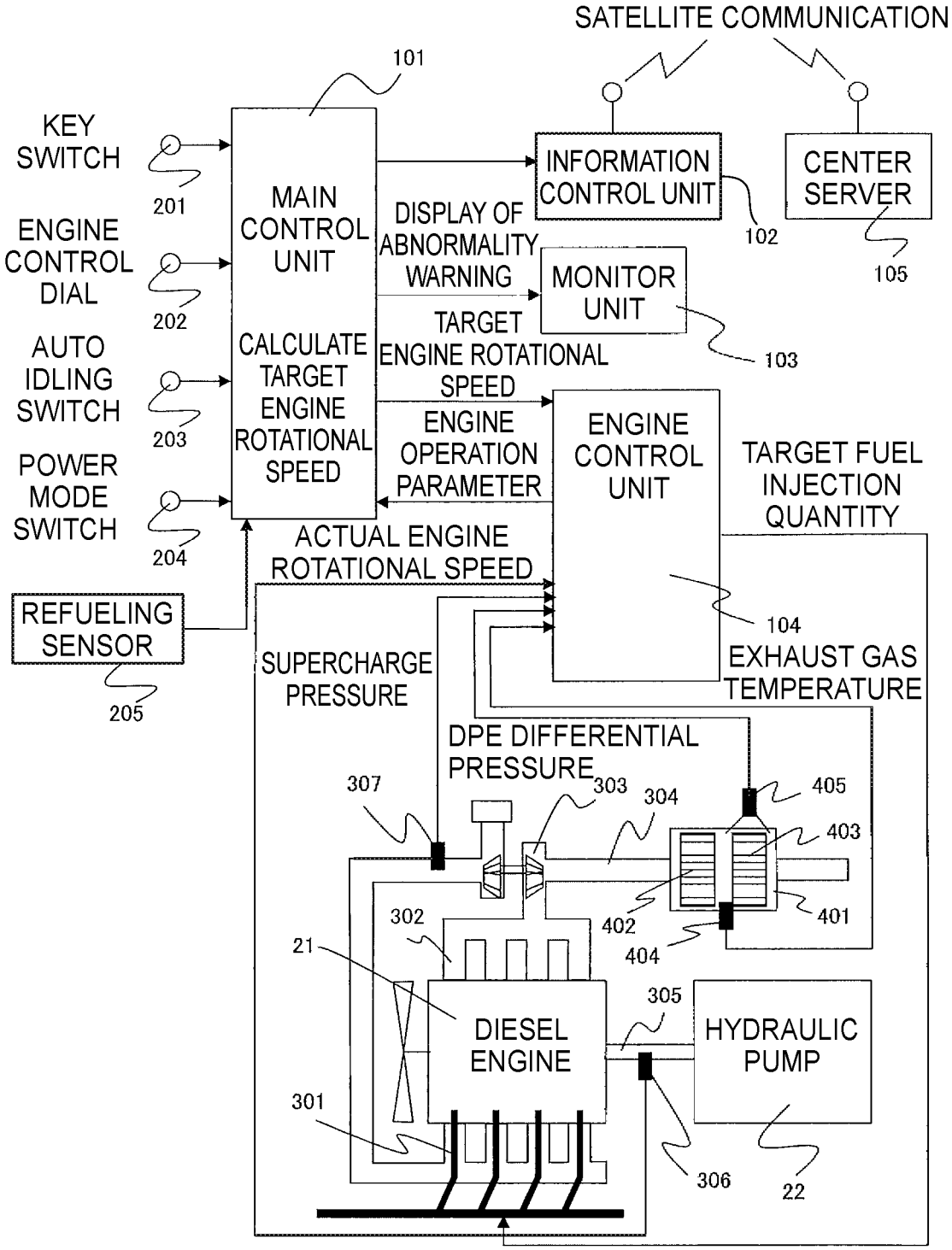
FIG. 12 is an illustration showing an engine for a hydraulic excavator and a system configuration therearound according to a second embodiment.

FIG. 12 is an illustration showing an engine for a hydraulic excavator and a system configuration therearound according to the second embodiment. The present configuration is almost the same as the configuration illustration of the first embodiment shown in FIG. 3, and as the control unit for controlling the hydraulic excavator 1, an information control unit 102 is added in addition to the main control unit 101, the monitor unit 103 and the engine control unit 104. The information control unit 102 is electrically connected to the main control unit 101 by a signal line. Further, the information control unit 102 is able to mutually communicate with the center server 105 by way of a satellite communication, so that the information control unit 102 can transmit the individual information of the hydraulic excavator 1 to the center server 105 and can receive infrastructure information, reference information to each individual and command values from the center server 105.

Figure 13:
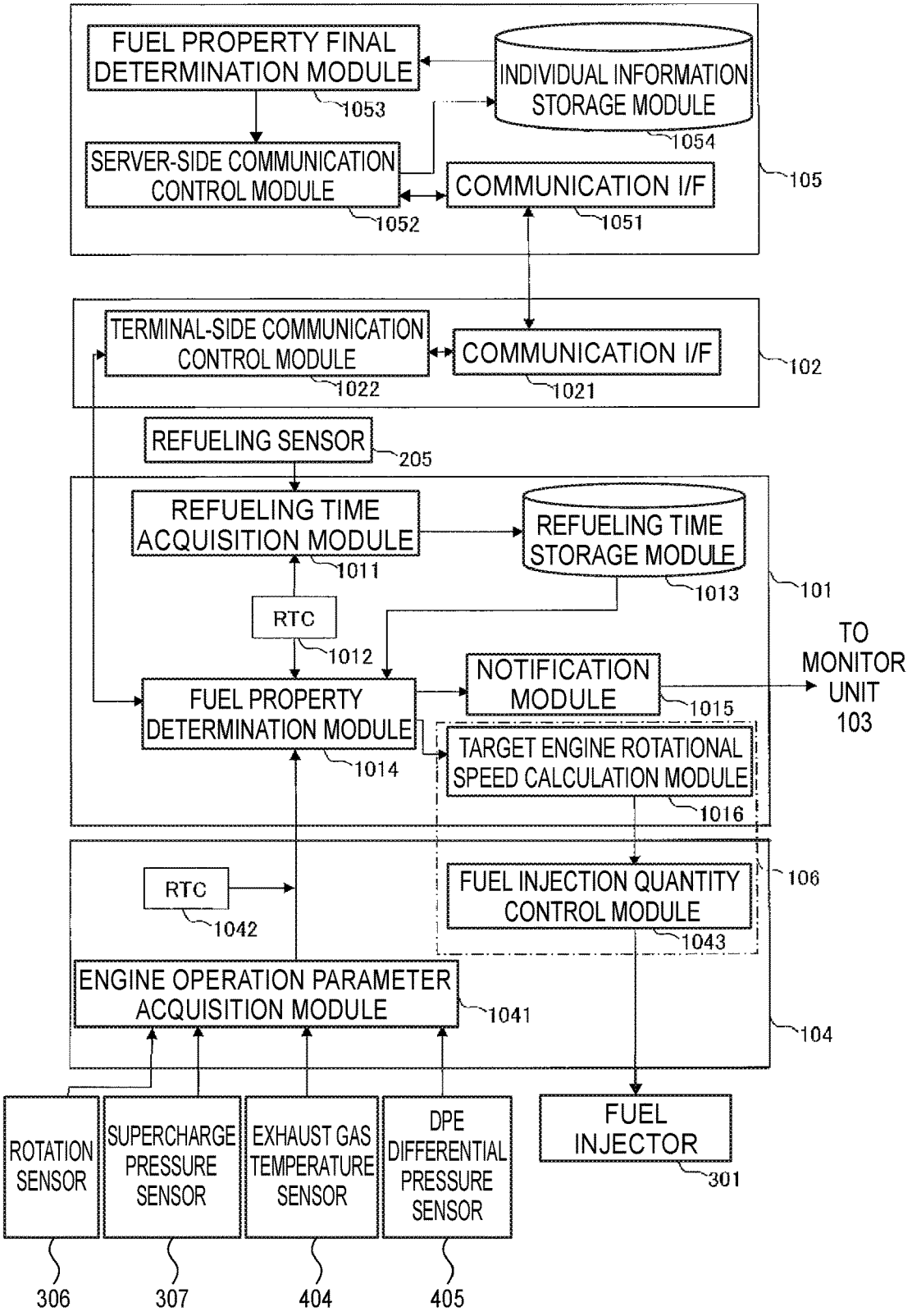
FIG. 13 is a block diagram showing the function configuration for a fuel property processing according to the second embodiment.

FIG. 13 is a block diagram showing the function configuration for fuel property processing according to the second embodiment. Of the function blocks shown in FIG. 13, the configurations of the engine control unit 104 and the main control unit 101 are the same as those in the first embodiment shown in FIG. 4. The information control unit 102 includes a terminal-side communication control module 1022 that receives inputs of individual information including the refueling time and the engine operation parameter for each hydraulic excavator 1 from the engine control unit 104 and the main control unit 101 and that performs transmit-receive control between itself and the center server 105. This terminal-side communication control module 1022 transmits to the center server 105 individual information being the information relating to the property determination processing for the fuel of each hydraulic excavator 1 and receives instruction information that instructs the restriction of the output power of the engine of a hydraulic excavator being an object to be determined, based on the final determination result from a server-side communication control module 1052 referred to later. Furthermore, the terminal-side communication control module 1022 may be configured to receive either or both of result information representing the result itself of a final determination and instruction information. A communication I/F 1021 is constituted by an input/output port such as a USB, and the terminal-side communication control module 1022 is configured by a driver software for the communication I/F 1021, a program that performs a processing for executing the conversion of the individual information into a transmit-receive format conforming to a communication protocol as well as for executing the reverse conversion therefrom, and hardware that executes those software and program.

The center server 105 includes a communication I/F 1051, the server-side communication control module 1052, a fuel property final determination module 1053, and an individual information storage module 1054. The fuel property final determination module 1053 chooses a plurality of individual information satisfying the condition that enables the same fuel to be considered as having been refueled, from individual information including the fuel property determination results received from the respective hydraulic excavators and engine operation parameters, the T1 and the T2 that were used for the determinations, and executes a final determination of the fuel property by the use of these information. An individual information storage module 1054 stores the individual information the server-side communication control module 1052 receives through the communication I/F 1051. The server-side communication control module 1052 receives individual information from the respective hydraulic excavators 1 and transmits, based on the final determination result, instruction information for instructing the restriction of the output power of the engine of a hydraulic excavator 1 being an object to be determined and/or result information representing a determination result to the terminal-side communication control module 1022 provided on the hydraulic excavator being the object to be determined. The communication I/F 1051, the server-side communication control module 1052, the fuel property final determination module 1053, and the individual information storage module 1054 are configured by the cooperation of hardware, composed of a CPU (Central Processing Unit), a RAM (Random Access Memory), a ROM (Read Only Memory), an HDD (Hard Disk Drive) and the like which constitute the center server 105, with software that realizes the functions of the respective components.

Figure 14:
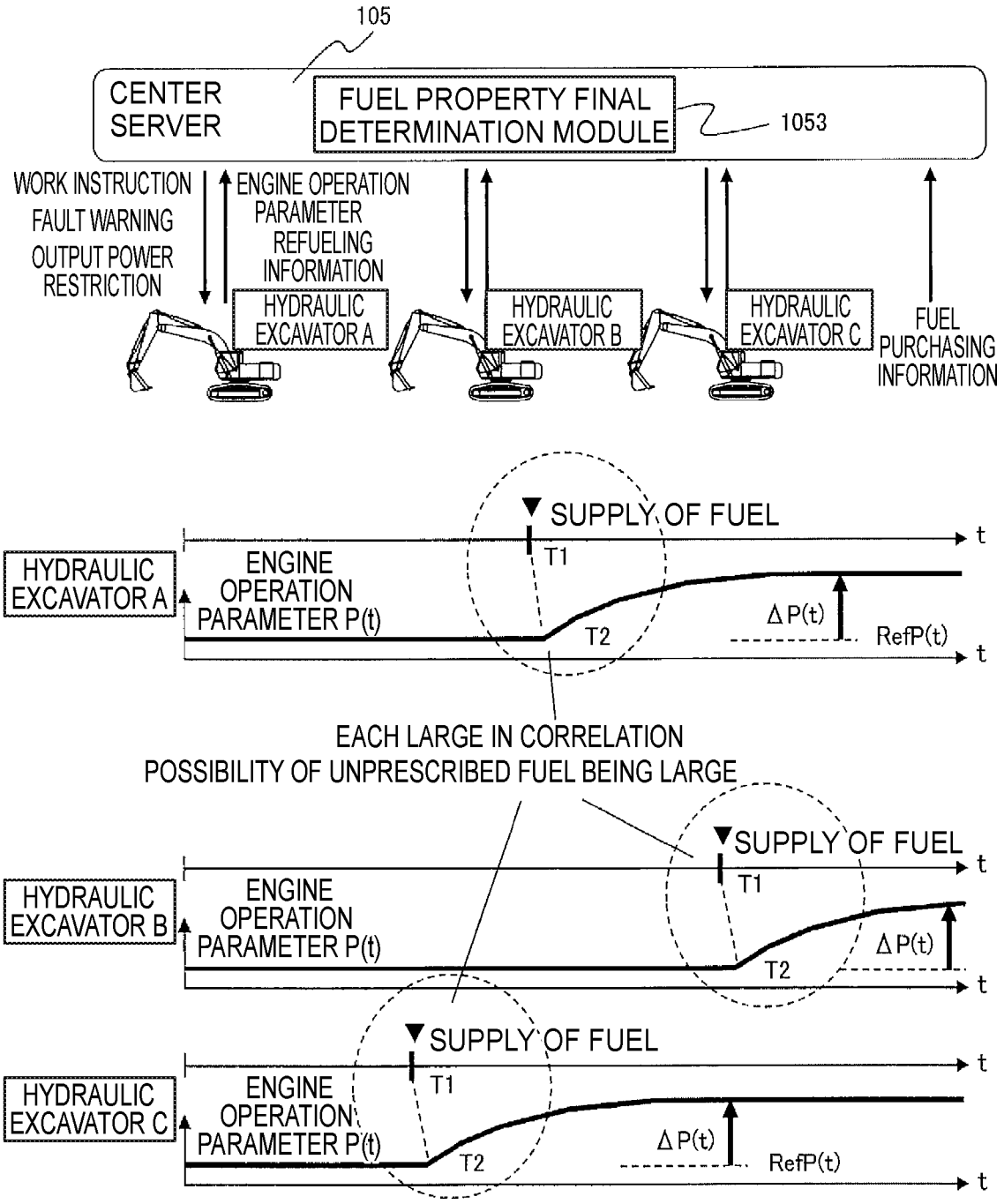
FIG. 14 is a chart showing a fuel property determination logic according to the second embodiment.

Next, with reference to FIG. 14, description will be made regarding the way of thinking for the fuel property determination in the second embodiment. FIG. 14 is a chart showing a fuel property determination logic according to the second embodiment. The fuel property determination logic in the second embodiment takes the base on the fuel property determination logic in the first embodiment. For a start, in the individual of each hydraulic excavator, the fuel property determination module 1014 makes the following determination by the aforementioned arithmetic expressions (1)-(9) and based on the calculation results of the T1, the T2, the ΔP_max and the like. "The fuel in use is prescribed fuel", "The fuel in use is unprescribed fuel (abnormality being minor)" or "The fuel in use is unprescribed fuel (abnormality being major)". Then, the information control unit 102 transmits the individual information to the center server 105. At this time, the engine operation parameter used in the determination may also be transmitted.

The center server 105 collects the individual information for the respective hydraulic excavators through the communication I/F 1051 and stores the information in the individual information storage module 1054. The fuel property final determination module 1053 takes purchasing information on fuel, regional information and the like into account and makes a final fuel property determination by the execution of a majority rule processing or the like of the individual information.

The server-side communication control module 1052 of the center server 105 transmits the determination result of the fuel property final determination module 1053 to the information control unit 102 of each hydraulic excavator through the communication I/F 1051. Each hydraulic excavator individual processes the result in the main control unit 101 to execute an exact processing meeting the fuel property.

Figure 15:
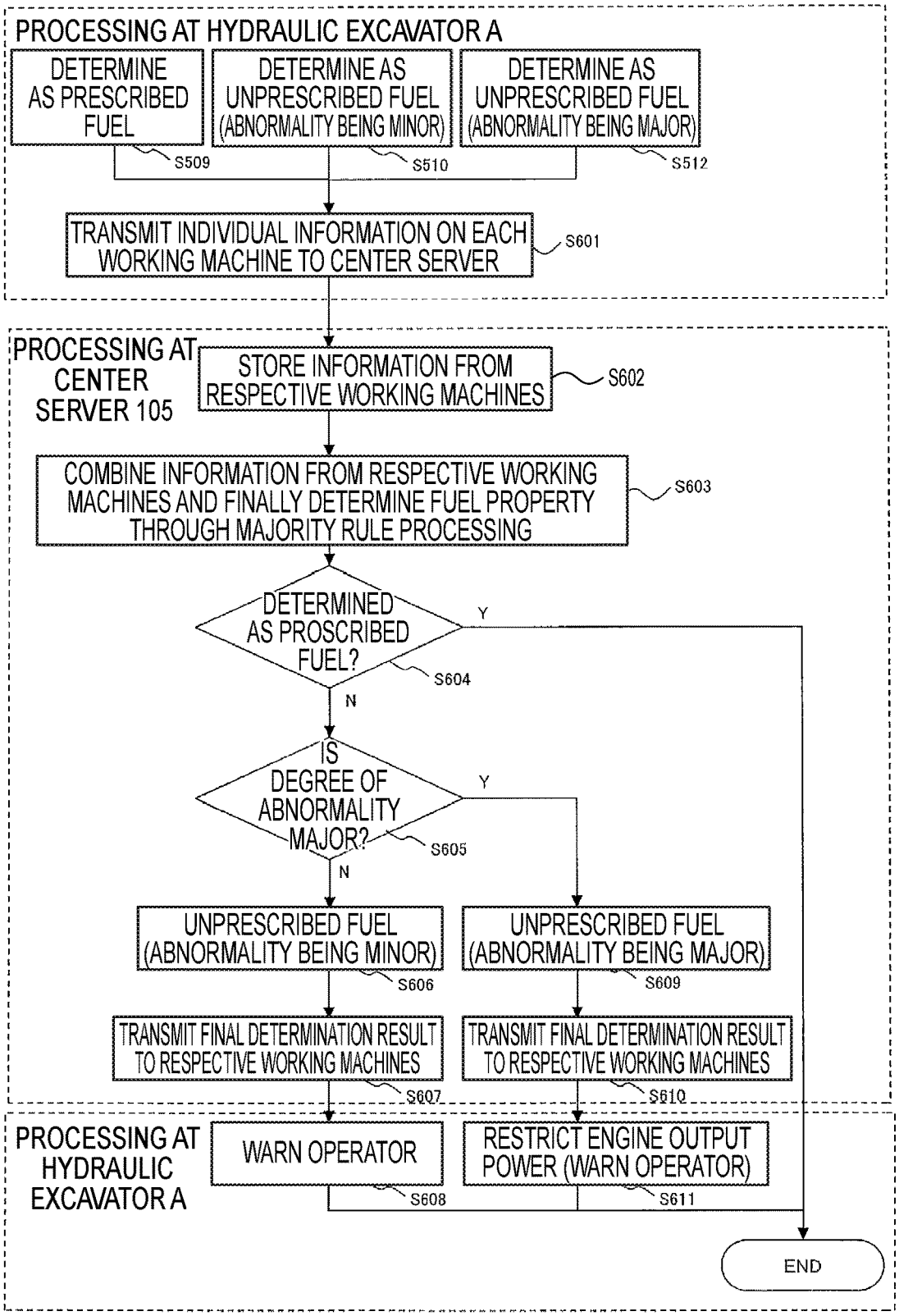
FIG. 15 is a flowchart showing an arithmetic processing for the fuel property determination logic according to the second embodiment.

Next, with reference to FIG. 15, description will be made regarding the flow of an arithmetic processing for the fuel property determination logic in the second embodiment. FIG. 15 is a flowchart showing the arithmetic processing for the fuel property determination logic according to the second embodiment. Since the arithmetic operation flowchart in the second embodiment and the arithmetic operation flowchart in the first embodiment have the steps up to the computation step S509, the computation step S510 and the computation step S511 in common, the difference only will be described later.

Following the processing at the computation steps S509-S511 in the fuel property determination processing for the individual of each hydraulic excavator (hydraulic excavator A in FIG. 15), the processing proceeds to computation step S601. At this step, the information control unit 102 transmits individual information including the determination results at the computation steps S509-S511 to the center server 105 (S601). In this case, it may be done to mount a position detector such as a GPS (Global Positioning System) or the like on each hydraulic excavator, to calculate the position information at the aforementioned refueling timing T1 of the hydraulic excavator in advance, and to make the individual information include the position information. In this case, the final determination is executed by also using the position information in a processing referred to later by the fuel property final determination module 1053.

In the center server 105, the server-side communication control module 1052 receives individual information from the respective hydraulic excavators through the communication I/F 1051 and stores the information in the individual information storage module 1054. In the individual information storage module 1054, identification information by which each hydraulic excavator can be uniquely indentified is stored in association with the individual information (S602).

The fuel property final determination module 1053 extracts individual information satisfying the condition that enables the same fuel to be considered as having been refueled, from the individual information for the plurality of hydraulic excavators stored in the individual information storage module 1054 and makes a final determination for the fuel property of the respective hydraulic excavators by the use of these information (S603). As the aforementioned condition, for example, where a plurality of hydraulic excavators are in operation at one loading site in a mine and where an oil supply vehicle goes around to feed oil to the hydraulic excavators, it can be supposed experientially that timings at which the hydraulic excavators running at the same loading site are refueled comes within a predetermined time range (refueling period of time for one hydraulic excavator×the number of excavators+margin periods of time taken to replace hydraulic excavators). Further, where the refueling timing is determined to be in the morning and in the evening in a day, the fuel property final determination module 1053 is not required to set the aforementioned predetermined time range strictly and may extract individual information whose T1 indicates the morning on the same day or the evening on the same day. Furthermore, where the individual information includes position information at the refueling timing, the fuel property final determination module 1053 may add it to the aforementioned condition that information on a position at the same loading site is included. Thus, accuracy can be further improved in extracting the individual information indicating that the same fuel has been refueled.

Then, the fuel property final determination module 1053 combines the extracted individual information and makes a final fuel property determination through a majority rule processing or the like. For example, where, of the extracted individual information, all are given a determination of being unprescribed fuel (fuel property being poor), there is given a final determination result that the cause of the abnormality in the engine operation parameter value is attributed to the fuel property. On the contrary, where, of the extracted individual information, only one hydraulic excavator is given a determination of being unprescribed fuel (fuel property being poor), there is give a final determination that the cause of the abnormality in the engine operation parameter value is attributed not to the fuel property but to the cause inherent to that hydraulic excavator (for example, abnormality of the engine main body).

At computation step S603, if the fuel property final determination module 1053 makes a final determination of being prescribed fuel (S604/Yes), the fuel property determination processing is ended.

If the fuel property final determination module 1053 makes a final determination of being unprescribed fuel (S604/No) and determines that the degree of the abnormality in each individual information is minor (S605/No), the fuel property final determination module 1053 determines the final determination result for a hydraulic excavator designed by the hydraulic excavator identification information associated with that individual information as "unprescribed fuel (abnormality being minor)" (S606). Then, the center server 105 transmits to each hydraulic excavator the final determination result for the hydraulic excavator concerned (S607). At computer step S608, each hydraulic excavator notifies the operator that the abnormality is minor (S608). Incidentally, the foregoing computation steps S605 and S608 are the same processing as the computation steps S508 and S511 in the first embodiment. Thereafter, the arithmetic operation is terminated.

If the fuel property final determination module 1053 makes a final determination of being unprescribed fuel (S604/No) and determines that the degree of the abnormality in each individual information is major (S605/Yes), the fuel property final determination module 1053 determines the final determination result for a hydraulic excavator designed by the hydraulic excavator identification information associated with that individual information as "unprescribed fuel (abnormality being major)" (S609). Then, the center server 105 transmits to each hydraulic excavator the final determination result for the hydraulic excavator concerned (S610). At computer step S611, the hydraulic excavator determined to be major in abnormality restricts the output power of the engine and notifies the operator that the abnormality is major (S611). Incidentally, the foregoing computation step S608 is the same processing as the computation step S513 in the first embodiment. Thereafter, the arithmetic processing is terminated.

According to the present embodiment, in inferring the fuel property from an engine operation parameter, the correlation of the time at which the engine operation parameter changes, with the time at which refueling is done is taken into account to make a final fuel property determination, and thus, the influence attributed to the engine main body can be separated, so that the accuracy in inferring the fuel property determination can be improved. Further, in the present embodiment, the final determination in the fuel property determination is not made for the individual of a hydraulic excavator, and the determination information for the individuals of hydraulic excavators are collected to the center server 105 to increase the amount of information, and then, the final determination is made by means of a majority rule processing or the like, so that it becomes possible to make the fuel property determination further accurately.

Third Embodiment

Figure 16:
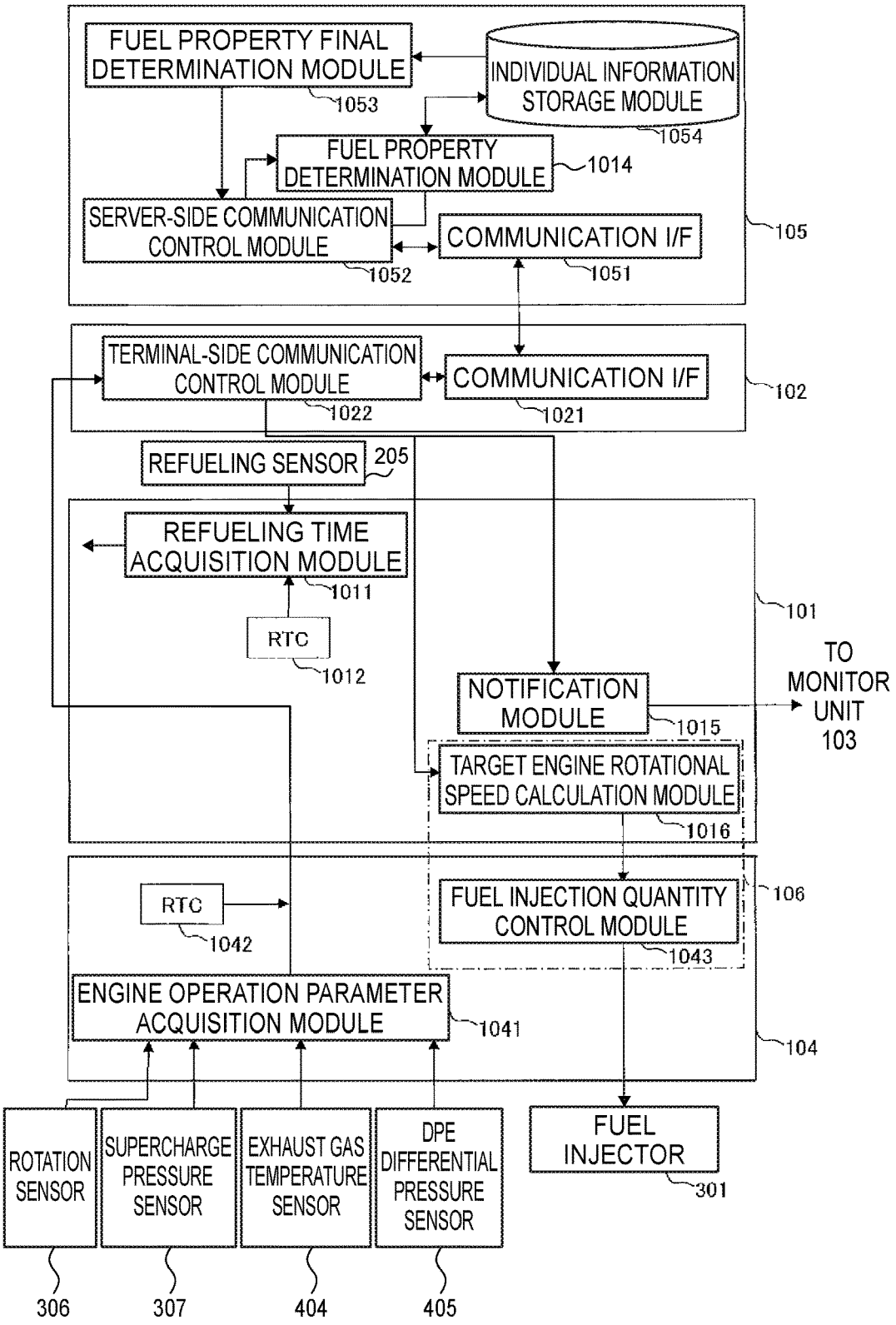
FIG. 16 is a block diagram showing the function configuration for a fuel property processing according to a third embodiment.

Next, a third embodiment of the present invention will be described. Although in the second embodiment, the fuel property determination is made independently for the individual of each hydraulic excavator, the third embodiment differs from the second embodiment in that the center server is provided with a fuel property determination module wherein the fuel property is determined for the individual and is compared with the fuel properties of other hydraulic excavators to execute the final determination of the fuel property. Hereafter, the third embodiment will be described with reference to FIG. 16. FIG. 16 is a block diagram showing the function configuration for a fuel property processing according to the third embodiment.

As shown in FIG. 16, the center server 105 is provided with the fuel property determination module 1014. In this instance, the each hydraulic excavator transmits as individual information not the information indicative of the property determination result of fuel but the information (refueling timing information) indicative of the refueling time for each hydraulic excavator and the engine operation parameter of the same hydraulic excavator, to the center server 105. The transmission timing is the time when the refueling time acquisition module 1011 acquires the refueling timing. The center server 105 stores in the individual information storage module 1054 the refueling timing information upon receipt of the same. Further, the engine operation parameter acquisition module 1041 may transmit an engine operation parameter each time the same is acquired.

Upon receiving an engine operation parameter, the fuel property determination module 1014 in the center server 105 reads out refueling timing information for the respective hydraulic excavators from the individual information storage module 1054 and determines the fuel property on a unit basis of each hydraulic excavator, that is, on an individual basis. The individual information storage module 1054 stores the determination result. Then, the fuel property final determination module 1053 finally determines the fuel property of the hydraulic excavator concerned in comparison with the determination results of other hydraulic excavators stored in the individual information storage module 1054. The center server 105 transmits the final determination result to the hydraulic excavator being the object to be determined. The hydraulic excavator, upon receiving the final determination result, executes a notification and the output power restriction of the engine in accordance with the determination result.

According to the present embodiment, because the fuel property determination module is provided in the center server only but is not required to be provided in each of the hydraulic excavators, the maintenance (for example, update of the programs) for the fuel property determination module can be done easily. Further, because the number of the components mounted on each hydraulic excavator can be decreased, the application of the present invention becomes easy even in the case that the number of hydraulic excavators being the objects to be monitored increases.

The foregoing embodiments are exemplifications for the purpose of describing the present invention and are not purported to limit the scope of the present invention to the foregoing embodiments. Any person of an ordinary skill in the art can implement the present invention in other various forms without departing from the gist of the present invention.

REFERENCE SIGNS LIST

1 Hydraulic excavator
2 Working mechanism
3 Vehicle body
4 Revolving upperstructure
5 undercarriage
6 Boom
7 Arm
8 Bucket

9 Boom cylinder
10 Arm cylinder
11 Bucket cylinder
41 Center joint
43 Travel reduction gear
44 Crawler

The invention claimed is:

1. A work machine monitoring system comprising a monitoring server connected to a plurality of work machines through a network, wherein each of the work machines comprises an engine and a position detection module, and the monitoring server is programmed to:

receive, from each of the plurality of work machines, individual information of the respective work machine comprising an engine operation parameter representing an operation state of the engine mounted on the respective working machine, a refueling timing at which fuel is supplied to the respective working machine and position information of the respective work machine output from the position detection module;

determine that a cause of a change in the engine operation parameter of one of the work machines is due to a change in a fuel property, if a change amount of the engine operation parameter of the one of the work machines exceeds a first threshold value which is a reference value corresponding to a predetermined fuel type within a first time period in which an influence by the fuel property is considered to arise;

when it is determined that the fuel of the one of the work machines is abnormal, extract the individual information including the position information of the plurality of work machines at a same loading site as the one of the work machines within a predetermined time range;

when the extracted individual information shows that there is an abnormality in the fuel among of the plurality of work machines at the same loading site as the one of the work machines within the predetermined time range, determine that the cause of the change in the engine operating parameter of the one of the work machines is based on the abnormality in the fuel;

when the extracted individual information shows that there is no abnormality in the fuel among of the plurality of work machines at the same loading site as the one of the work machines within the predetermined time range, determine that the cause of the change in the engine parameter of the one of the work machines is not based on the abnormality in the fuel of the one of the work machines but is inherent to the of the one of the work machines; and when the abnormality in the fuel of the one of the work machines is determined, transmit an instruction information for instructing a restriction in output power of the engine for the one of the work machines.

2. The monitoring system for a work machine according to claim 1, wherein the engine operation parameter further comprises:

a particulate matter discharged from the engine, a supercharge pressure of the engine, an exhaust temperature representing the temperature of the exhaust gas discharged from the engine, and a rotation fluctuation during idling of the engine.

* * * * *